US005395108A

United States Patent [19]

Souders et al.

[11] Patent Number: 5,395,108

[45] Date of Patent: Mar. 7, 1995

[54] SIMULATED WOOD COMPOSITE BALL BAT

[75] Inventors: Roger B. Souders, Poway; Craig W. Souders, San Diego, both of Calif.

[73] Assignee: Easton Aluminum, Inc., Van Nuys, Calif.

[21] Appl. No.: 183,738

[22] Filed: Jan. 19, 1994

[51] Int. Cl.[6] ..... A63B 59/06

[52] U.S. Cl. ..... 273/72 R

[58] Field of Search ..... 273/72 A, 72 R, 67 R, 273/26 B, 73 J, 80.8, 80 R, 67 A

[56] References Cited

U.S. PATENT DOCUMENTS

| | | | |
|---|---|---|---|
| 3,697,069 | 10/1972 | Merola | 273/72 A |
| 3,830,496 | 8/1974 | Reizer | 273/72 R |
| 4,056,267 | 11/1977 | Krieger | 273/72 A |
| 4,541,629 | 9/1985 | Witkowski | 273/72 R |
| 4,848,745 | 7/1989 | Bohannan et al. | 273/72 R |
| 5,301,940 | 4/1994 | Seki et al. | 273/72 R |

*Primary Examiner*—Mark S. Graham

*Attorney, Agent, or Firm*—Roth & Goldman

[57] ABSTRACT

An synthetic wood composite ball bat (10) having no wood components comprises a rigid shell of fiber reinforced composite material filled with expansible urethane foam to develop compressive stressed therebetween. The foam is locked to the shell during the manufacturing process by use of an intermediate dry woven fiber tube into which resin from the composite shell flows during curing of the composite shell and into which urethane foam flows during expansion of the urethane foam filler.

17 Claims, 2 Drawing Sheets

SIMULATED WOOD COMPOSITE BALL BAT

CROSS REFERENCE TO RELATED APPLICATIONS

None

BACKGROUND OF THE INVENTION AND PRIOR ART

1. Field of the Invention

This invention relates in general to ball bats and, more particularly, to bats made of composite materials rather than metal or wood and enhancement of the performance characteristics thereof to make the bat look, feel and sound like a wood bat during impact with the ball. Although the present description will refer specifically to ball bats such as baseball or softball bats, the teachings herein are also applicable to other types of ball impacting articles such as cricket bats.

2. Prior Art

Wooden ball bats for softball and baseball are well known as are more recently developed durable metal bats which do not break or chip. Most metal bats are made principally of aluminum which can be coated to look like wood but which performs differently than wood bats and is known to create a metallic or pinging sound rather than the traditional "crack of the bat" heard when a wood bat impacts a ball. Metal bats are considered artificial or aesthetically unpleasing by some more traditionally oriented individuals who are used to the typical appearance, performance and sound made by impact of a wood bat.

Metal ball bats are distinctly advantageous in that, while more expensive to manufacture, they do not break and can therefore be used repeatedly with consequent cost savings. Although metal bats have a larger "sweet spot" and generally perform better than wood and have been found acceptable at levels from Little League up through college baseball, metal bats have not yet been approved for Major League or minor league baseball use, partly because the ball comes off of a metal bat faster and, secondly, because of the undesirable pinging sound normally associated with metal bats. Such metal bats are of various types including unreinforced metal shells as well as metal shells which are reinforced externally or internally with a layer or layers of composite fiber reinforcement such as resin impregnated carbon fibers.

One example of prior art aluminum bats is disclosed in U.S. Pat. No. 4,505,479 issued Mar. 19, 1985 to Roger B. Souders. This patent discloses a weighted aluminum bat overwrapped with woven or braided composite-type materials such as graphite, Kevlar, glass and boron.

At least one attempt has been made to make aluminum core bats perform and look like wood bats. U.S. Pat. No. 5,114,144 issued May 19, 1992 to Baum discloses a wood composite baseball bat having an aluminum core overwrapped with a composite reinforcing layer and covered with an outer layer of resin coated wood veneer. This bat is complex and expensive to manufacture and uses an actual wood exterior to achieve the performance and appearance of a wood bat.

OBJECT OF THE INVENTION

The primary object of the present invention is to provide a durable, cost competitive bat that looks, feels and performs like a wood bat without the use of wood or metal therein.

A further object to provide a method of manufacturing simulated wood bats that will, through simple variations in the manufacturing steps, easily produce bats of varying size and performance characteristics such as differing weights and balances.

SUMMARY OF THE INVENTION

The present invention accordingly provides a simulated wood composite ball bat having a longitudinal axis, a handle end and a barrel end comprising:

a) a tubular bat shell comprising a plurality of cured layers of fiber reinforced resin material;
b) a fiber tube inside of said shell and having cured resin material from said shell penetrating at least the outer portion of said fiber tube;
c) a rigid cured expansible urethane foam having an expanded density of from 15 to 40 pounds per cubic foot substantially filling said shell and penetrating the inner portion of said fiber tube with substantial pressure between said shell and said foam; and
d) a bat handle knob and a barrel end cap affixed to the ends of said shell.

The present invention further provides a method of making a simulated wood composite ball bat having a longitudinal axis which comprises a shell having a handle end and a barrel end, comprising the steps of:

a) placing a fiber tube on a mandrel having the shape, inside diameter and profile of a finished bat shell;
b) placing a plurality of layers of resin coated reinforcing fibers on said fiber tube and mandrel to form said bat shell;
c) compacting and simultaneously heat curing said shell to flow said resin to penetrate at least the outer portion of said fiber tube;
d) sealing the ends of said cured shell;
e) partially filling said shell with measured amounts of liquid components of an expansible urethane foam having an expanded density of from 15 to 40 pounds per cubic foot;
f) expanding said urethane foam in said shell to cause uncured foam to penetrate the inner portion of said fiber tube and substantially completely fill said shell creating substantial pressure between said shell and said foam; and
g) assembling a bat handle knob and a barrel end cap to the ends of said shell.

DESCRIPTION OF THE PREFERRED EMBODIMENT

Figure 1:
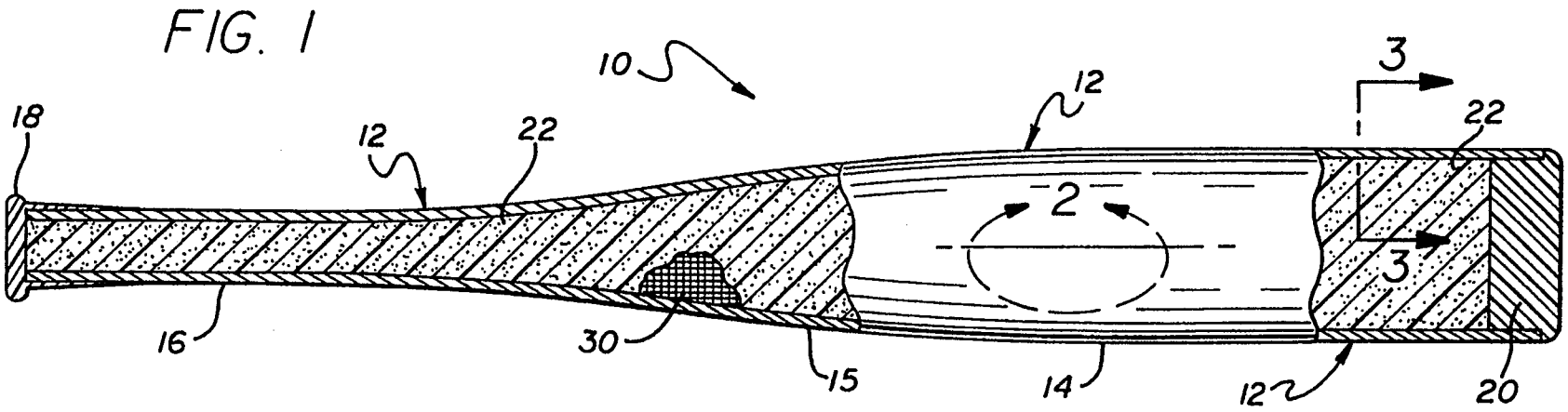
FIG. 1 is a longitudinal cross-sectional view of a bat showing the internal construction thereof.

As seen in FIG. 1 the simulated wood composite baseball bat 10 of the present invention is comprised of an outer tubular bat shell 12 having a barrel portion 14, a tapered portion 15, a handle portion 16, a knob 18 molded onto the end of the handle portion and an end cap 20 molded onto the end of the barrel portion 14 of the bat. Rigid expansible urethane foam 22 substantially completely fills the interior of the bat shell 12 between the knob 18 and end cap 20.

The simulated wood composite bat of the present invention is manufactured by first placing a dry fiber tube or sock 30 on a solid mandrel (not shown) which has the shape, inside diameter and profile of a finished bat shell. In practice, a 1.5' diameter dry braided graphite tube 30 has been successfully used to efficiently bond the outer shell 12 to the expansible urethane foam 22. Tubes of other fibers such as fiberglass or Kevlar could of course be used in the construction if desired.

Figure 2:
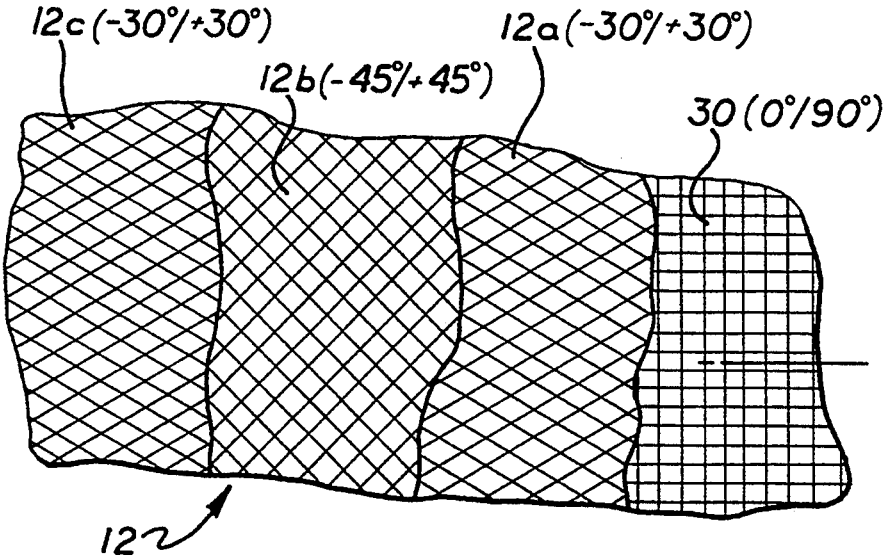
FIG. 2 is a transverse cross-section of the bat shown in FIG. 1.
Figure 3:
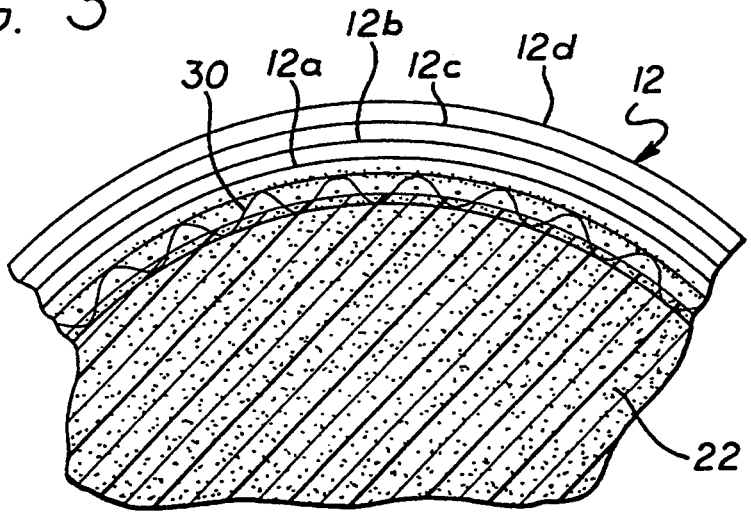
FIG. 3 is a portion of FIG. 2 drawn to an enlarged scale.

After the fiber tube 30 is placed on the solid mandrel, a plurality of layers or plies 12*a*, 12*b*, 12*c*, 12*d* (FIG. 3) of resin coated reinforcing fibers or filaments are wound onto, or sheets of prepreg material are laid on top of the fiber tube and mandrel to form an uncured bat shell. Preferably, a thermosetting epoxy resin prepreg is used; however, the teachings of the invention are equally applicable to thermoplastic resins. When prepreg material is used, each ply of prepreg material is ordinarily comprised of two layers of unidirectional fibers oriented such that the unidirectional fibers form substantially equal plus and minus angles with respect to the longitudinal axis L of the bat as seen in FIG. 2. For example, the first laid or innermost ply may have fibers oriented at plus and minus 30° with reference to the longitudinal axis of the bat. The second ply may then have its fibers oriented at plus and minus 45°; the third ply at plus and minus 30° and so forth. Preferably, the average absolute angle which the unidirectional reinforcing fibers make with the longitudinal axis of the bat falls within the range of 25°–50°. In practice, as many as eight plies have been used and, without limitation, the eight plies may be alternated such that the first or innermost ply has fibers oriented at plus and minus 30°, the second ply has fibers oriented at plus and minus 45° with subsequent layers alternating between 30° and 45°.

The laid up plies of epoxy resin prepreg material (or wound filament strands) are then compacted against the solid mandrel and heat cured to cause the resin of the prepreg to be squeezed into and penetrate at least the outer portion of the fiber tube 30. Preferably, the heating and compaction is maintained at times and pressures long enough to insure that the resin penetrates up to, but not substantially exceeding 50% of the thickness of the wall of the fiber tube 30.

The solid mandrel is then removed from the compacted and cured shell 12 having the dry graphite tube 30 securely bonded therein. The shell 12 is then partially filled with measured amounts of two liquid components of an expansible urethane foam 22 which, when mixed, causes the urethane to foam inside of the bat shell and expand generating substantial internal pressure in the shell 12 of the order of about 100 PSI. The urethane foam is chosen to have an expanded density of from 15–40 pounds per cubic foot. During expansion of the urethane, the foam penetrates the inner portion of the fiber tube 30 and substantially completely fills the shell 12 with the dry graphite fiber tube 30 securely locking and bonding the expansible urethane foam 22 to the cured shell 12.

The bat handle end knob 18 and barrel end cap 20 are assembled to the ends of the shell 12. Preferably, the knob is a rigid urethane molded component measuring 90 on a Shore durometer cast over the outer end of handle portion 16 as shown in FIG. 1.

Finally, a simulated wood grain finish is preferably applied to the exterior surface of the bat by a hydrographic decal process as is well known in the art of manufacture of simulated wood articles.

Without limitation, a bat having a substantially constant shell wall thickness was constructed according to the following specific example. Although a constant wall thickness is not always necessary and the designer may wish to vary the wall thickness, our presently preferred embodiments typically employ a constant wall thickness of the shell 12 in the range of from 0.080 to 0.175 inches.

SPECIFIC EXAMPLE

A 34" composite bat weighing 31 oz. ws manufactured according to the above method by laying 8 plies of low modulus graphite fiber prepreg having approximately 34% resin content on top of a 1.5' diameter tube of 45° braided graphite fiber using the following steps:

1. Dry braided graphite tube is cut to 45.5" in length and slipped onto the bat mandrel, working the tubing until it conforms to the shape of the mandrel. A spiral winding of thin thread is then placed on top of the braided tube to secure it in place.

2. Unidirectional prepreg sheets of graphite are cut and constructed into two layer plies where the fibers are each oriented at either 30° or 45° plus or minus angles. Four plies are prepared having 30° plus and minus angles and four plies are prepared having 45° plus and minus angles.

3. The eight plies of epoxy prepreg are laid onto the braided graphite tube, one at a time in the following sequence: 30/45/30/45/30/45/30/45 to form a composite shell.

4. The composite shell is then compacted by applying a circular winding of $\frac{5}{8}$' wide nylon film at a tension of 20 pounds on top of the shell.

5. The wrapped mandrel and shell is then placed in a curing oven where a curing temperature of 260° is maintained for 120 minutes to fully cure the epoxy resin.

6. The nylon wrapping is then removed and the composite shell is removed from the mandrel and cut to the desired length.

7. The handle end of the bat is then machined to form grooves therein for holding the cast urethane handle knob onto the handle end of the bat.

8. The urethane knob is then cast onto the handle end of the bat.

9. Approximately 300 grams of expansible urethane foam components are then poured into the shell and the barrel end opening is then sealed to trap all foam inside the shell which expands to develop an internal shell pressure of about 100 PSI.

10. The expanded foam is then machined out of the barrel end of the bat to a depth of approximately 1'.

11. A 0.050' deep locking groove is then machined into the inside shell wall about 0.5' from the end for locking a cast urethane end cap to the shell.

12. The barrel end cap is then cast from about 75 grams of urethane plastic following which the bat is sanded, color coated and finished by application of appropriate decals, logos, and urethane protective coatings.

Persons skilled in the art will readily appreciate that various modifications can be made from the preferred embodiment thus the scope of protection is intended to be defined only by the limitations of the appended claims.

We claim:

1. A simulated wood composite ball bat having a longitudinal axis, a handle end and a barrel end comprising:

a) a tubular bat shell comprising a plurality of cured layers of fiber reinforced resin material;

b) a dry fiber tube inside of said shell and having cured resin material from said shell penetrating at least the outer portion of said dry fiber tube;

c) a rigid cured expansible urethane foam having an expanded density of from 15 to 40 pounds per cubic foot substantially filling said shell and penetrating the inner portion of said dry fiber tube with substantial pressure between said shell and said foam; and d) a bat handle knob and a barrel end cap affixed to the ends of said shell.

2. The simulated wood bat of claim 1, wherein said layers are formed from plies of prepreg material having unidirectional fibers which make an average absolute angle with the longitudinal axis of the bat in the range of 25 through 50 degrees.

3. The simulated wood bat of claim 2, wherein each ply is comprised of two layers of fibers respectively oriented at substantially equal plus and minus angles with respect to the longitudinal axis of said bat.

4. The simulated wood bat of claim 2, wherein said resin penetrates approximately 50% of the thickness of said tube.

5. The simulated wood bat of claim 4, wherein said expansible urethane penetrates approximately 50% of the thickness of said tube.

6. The simulated wood bat of claim 5, wherein said fiber tube is braided graphite fiber and said resin is epoxy.

7. The simulated wood bat of claim 3, wherein said unidirectional reinforcing fibers are graphite.

8. The simulated wood bat of claim 3, wherein said shell has a uniform wall thickness in the range of from 0.080′ through 0.175′.

9. The simulated wood bat of claim 8, wherein said handle knob and said end cap are cast onto said ends of said shell.

10. The simulated wood bat of claim 8, wherein said handle knob and said end cap are rigid urethane.

11. A method of making a simulated wood composite ball bat having a longitudinal axis which comprises a shell having a handle end and a barrel end, comprising the steps of:

a) placing a dry fiber tube on a mandrel having the shape, inside diameter and profile of a finished bat shell;

b) placing a plurality of layers of resin coated reinforcing fibers on said fiber tube and mandrel to form said bat shell;

c) compacting and simultaneously heat curing said shell to flow said resin to penetrate at least the outer portion of said dry fiber tube;

d) sealing the ends of said cured shell;

e) partially filling said shell with measured amounts of liquid components of an expansible urethane foam having an expanded density of from 15 to 40 pounds per cubic foot;

f) expanding said urethane foam in said shell to cause uncured foam to penetrate the inner portion of said dry fiber tube and substantially completely fill said shell creating substantial pressure between said shell and said foam; and g) assembling a bat handle knob and a barrel end cap to the ends of said shell.

12. The method of claim 11, wherein each layer of reinforcing fibers is formed from a prepeg ply comprised of two layers of fibers respectively oriented at substantially equal plus and minus angles with respect to the longitudinal axis of said bat, comprising the further step of laying said plies of unidirectional fiber material on said mandrel such that the average absolute angle which the unidirectional reinforcing fibers make with the longitudinal axis of the bat is in the range of 25 through 50 degrees.

13. The method of claim 11, wherein each layer of reinforcing fibers is a wound filament, comprising the step of winding said filament on said mandrel such that the average absolute angle which the filament makes with the longitudinal axis of the bat is in the range of 25 through 50 degrees.

14. The method of claim 11, comprising the step of causing said resin to penetrate approximately 50% of the thickness of said tube.

15. The method of claim 14, comprising the step of causing said expansible urethane to penetrate approximately 50% of the thickness of said tube.

16. The method of claim 11, comprising the step of casting said handle knob and said end cap onto said handle and barrel ends of said shell.

17. The method of claim 16, comprising the step of applying a wood grain finish to the exterior surface of said bat by a hydrographic decal process.

* * * * *